US007830252B2

(12) United States Patent
Keeney et al.

(10) Patent No.: US 7,830,252 B2
(45) Date of Patent: Nov. 9, 2010

(54) METHOD AND APPARATUS FOR PROVIDING AN ASIC CONTROLLED ALARM UNIT

(75) Inventors: Shawn P. Keeney, Eatontown, NJ (US); Joseph Kosich, South Toms River, NJ (US); Luy B. Nguyen, Colts Neck, NJ (US); John Yerger, Harleysville, PA (US); Erik Johnson, Philadelphia, PA (US)

(73) Assignee: Wheelock, Inc., Long Branch, NJ (US)

( * ) Notice: Subject to any disclaimer, the term of this patent is extended or adjusted under 35 U.S.C. 154(b) by 851 days.

(21) Appl. No.: 10/650,464

(22) Filed: Aug. 28, 2003

(65) Prior Publication Data

US 2005/0035851 A1 Feb. 17, 2005

Related U.S. Application Data

(60) Provisional application No. 60/495,305, filed on Aug. 14, 2003.

(51) Int. Cl.
*G08B 21/00* (2006.01)

(52) U.S. Cl. ..... 340/540; 340/539.27; 340/577; 340/581; 340/628; 340/692

(58) Field of Classification Search ..... 340/332, 340/326, 328, 333, 573.1–635
See application file for complete search history.

(56) References Cited

U.S. PATENT DOCUMENTS

| | | | | |
|---|---|---|---|---|
| 4,578,586 | A * | 3/1986 | Preston | 250/382 |
| 4,625,151 | A * | 11/1986 | Kataoka | 315/241 P |
| 5,595,075 | A * | 1/1997 | Chen | 70/95 |
| 5,675,311 | A * | 10/1997 | Burnett et al. | 340/384.4 |
| 5,691,704 | A * | 11/1997 | Wong | 340/628 |
| 5,694,118 | A * | 12/1997 | Park et al. | 340/632 |
| 5,896,092 | A * | 4/1999 | Bechtel | 340/815.73 |
| 6,078,269 | A * | 6/2000 | Markwell et al. | 340/825.5 |
| 6,166,647 | A * | 12/2000 | Wong | 340/628 |
| 6,307,328 | B1 * | 10/2001 | Ko et al. | 315/200 R |
| 6,311,021 | B1 | 10/2001 | Kosich | |
| 6,369,696 | B2 | 4/2002 | Curran et al. | |
| 6,437,698 | B1 * | 8/2002 | Byrne et al. | 340/630 |
| 6,532,406 | B1 * | 3/2003 | Schmedding et al. | 701/29 |
| 6,617,967 | B2 * | 9/2003 | Baldwin et al. | 340/384.6 |
| 2004/0169585 | A1 * | 9/2004 | Smith et al. | 340/384.2 |

* cited by examiner

*Primary Examiner*—Daniel Wu
*Assistant Examiner*—Son M Tang

(57) ABSTRACT

The present invention is an ASIC-controlled alarm unit. The ASIC circuit performs all the necessary control functions to provide audible and visual signaling when used with external horn and strobe circuits.

4 Claims, 7 Drawing Sheets

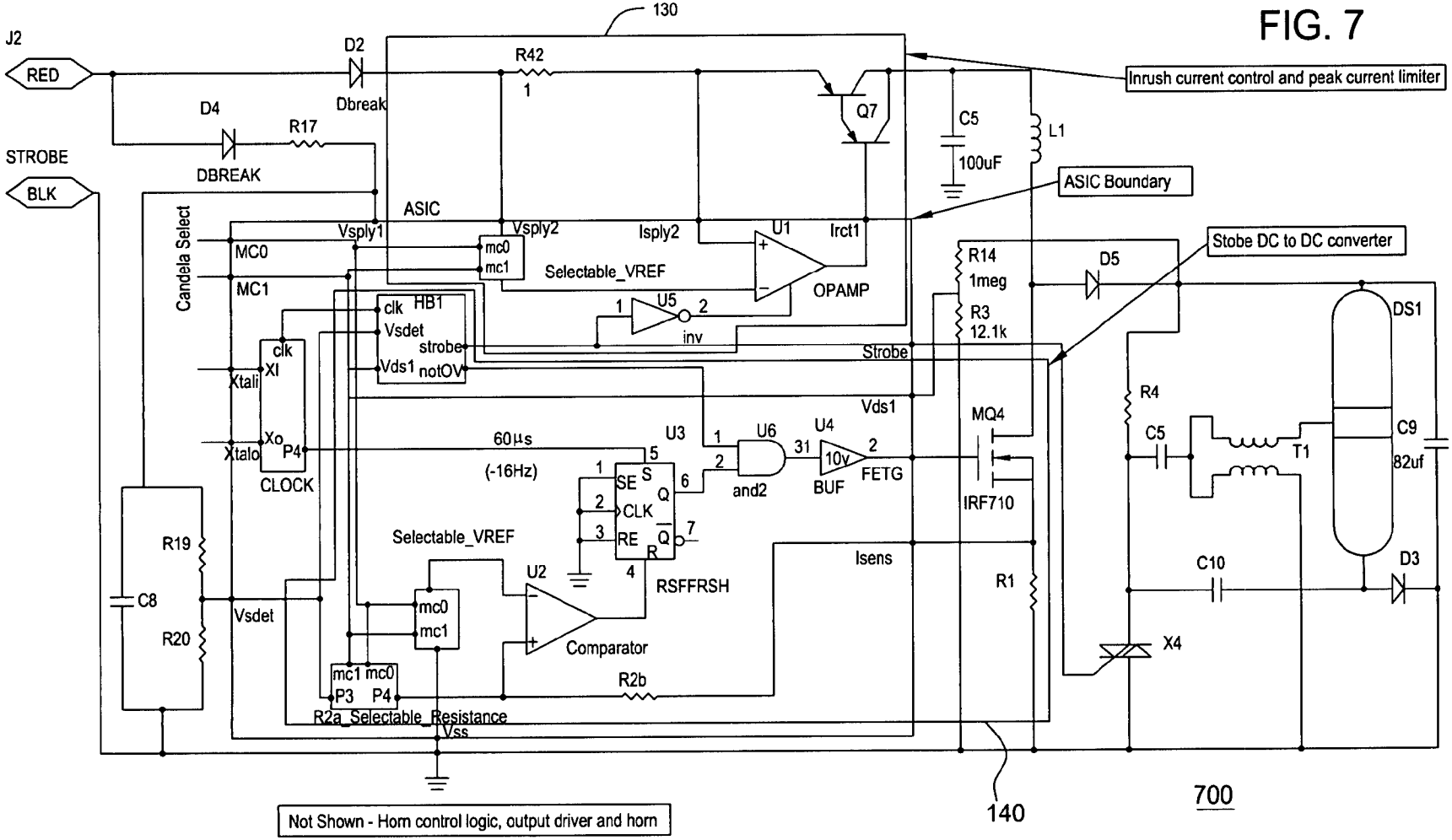
FIG. 7
Inrush current control and peak current limiter
ASIC Boundary
Stobe DC to DC converter
700
140
130
DS1
C9
82uf
D3
T1
C10
X4
R4
C5
D5
L1
R14
1meg
R3
12.1k
MQ4
IRF710
R1
C5
100uF
Q7
Irct1
OPAMP
U1
Strobe
Vds1
FETG
U4
10v
BUF
Isens
U6
and2
U3
RSFFRSH
SE
S
CLK
RE
R
Q
U5
inv
Isply2
Selectable_VREF
Comparator
R2b
U2
R42
Vsply2
mc0
mc1
60µs
(-16Hz)
ASIC
HB1
clk
Vsdet
strobe
Vds1
notOV
Selectable_VREF
mc0
mc1
P4
P3
R2a_Selectable_Resistance
Vss
D2
Dbreak
Vsply1
R17
D4
DBREAK
MC0
MC1
clk
XI
Xtali
Xo
Xtalo
P4
CLOCK
Vsdet
Candela Select
R19
R20
C8
J2
RED
STROBE
BLK
Not Shown - Horn control logic, output driver and horn

METHOD AND APPARATUS FOR PROVIDING AN ASIC CONTROLLED ALARM UNIT

This application claims the benefit of U.S. Provisional Application No. 60/495,305 filed on Aug. 14, 2003, which is herein incorporated by reference.

The present invention generally relates to an alarm unit. More particularly, the invention is a strobe alarm unit, a horn unit and/or a strobe and horn unit that is controlled by an ASIC (application specific integrated circuit) to provide audible and/or visual alarm notification.

BACKGROUND OF THE DISCLOSURE

Alarm units generally employ a microcontroller with an optocoupler (micro/opto design) to provide various features of the alarm units. Alarm units based on the micro/opto design have been proven to be reliable while providing excellent performance. Examples of such alarm units are disclosed in U.S. Pat. Nos. 6,369,696 and 6,311,021, which are assigned to the present assignee and are herein incorporated by reference.

However, in attempting to further improve alarm units based on the micro/opto design, it has been found that the micro/opto design has certain constraints. These constraints affect performance and the overall cost of the alarm unit.

Therefore, a need exists in the art for an alarm unit that is not based on the micro/opto design, thereby removing constraints that affect performance and the overall cost of the alarm unit that are attributable to the micro/opto design.

SUMMARY OF THE INVENTION

The present invention is an ASIC-controlled alarm unit. The ASIC circuit performs all the necessary control functions to provide audible and visual signaling when used with external horn and strobe circuits. Several illustrative advantages of the ASIC-controlled alarm unit are disclosed below.

In one embodiment, the strobe circuit with the ASIC operates at a constant frequency, e.g., 16 kHz as compared to the micro/opto circuit which operates at approximately 7 kHz. The faster switching speed allows for the use of a smaller inductor, thereby allowing the strobe circuit to operate more quietly because any magnetostriction caused by the inductor is at the upper threshold of the human hearing response.

In one embodiment, the new ASIC circuit has a more advanced peak current limiting circuit. The micro/opto circuit limited the initial peak current only during the initial power-up stage. The new circuit continuously senses the input current level and will limit the current any time it rises above a set level. The clamp level is determined by the voltage level on a resistor which is sensed by the ASIC, and the level can be changed by changing the sense resistor. This is an actively controlled current-limiter compared to other current-limiting schemes that use a passive foldback-type configuration.

In one embodiment, the ASIC circuit has improved MOSFET driving capability built into it. For example, it can drive a MOSFET at ten volts (or within an approximate range of 7.3-10.25 volts) with a faster on and off switching time (less than 400 nanoseconds), compared to the micro/opto circuit which drives the MOSFET at five volts and has a much slower switching speed (several microseconds). This improvement helps to reduce losses and makes the circuit efficiency better.

In one embodiment, the ASIC has two input pins which are used to set the candela setting for the strobe circuit. The pins are connected to a slide switch and can be a logic high (+5V) or a logic low (0V) depending on the switch position. Setting the candela sets an internal voltage reference level that is compared to the input on the ISENSE input pin. The old circuit had the candela switch on the input side of the circuit and it switched the sense resistances directly. The input current flowed directly through the switch. In the new circuit the input current does not flow through the switch.

In one embodiment, the ASIC offers more precise control of the strobe circuit. The energy level of the strobe is controlled by the voltage level on the sense resistor that goes to the ISENSE pin on the chip. This level is trimmed during the chip manufacturing process and is set within a much tighter tolerance limit compared to the micro/opto circuit. The micro/opto circuit relies on the tolerance of the forward voltage of the diode in the optocoupler and is less precise.

BRIEF DESCRIPTION OF THE DRAWINGS

The teachings of the present invention can be readily understood by considering the following detailed description in conjunction with the accompanying drawings, in which:

FIG. 7 illustrates a circuit diagram of one embodiment of an alarm unit employed in the present invention;

To facilitate understanding, identical reference numerals have been used, where possible, to designate identical elements that are common to the figures.

DETAILED DESCRIPTION

Figure 1:
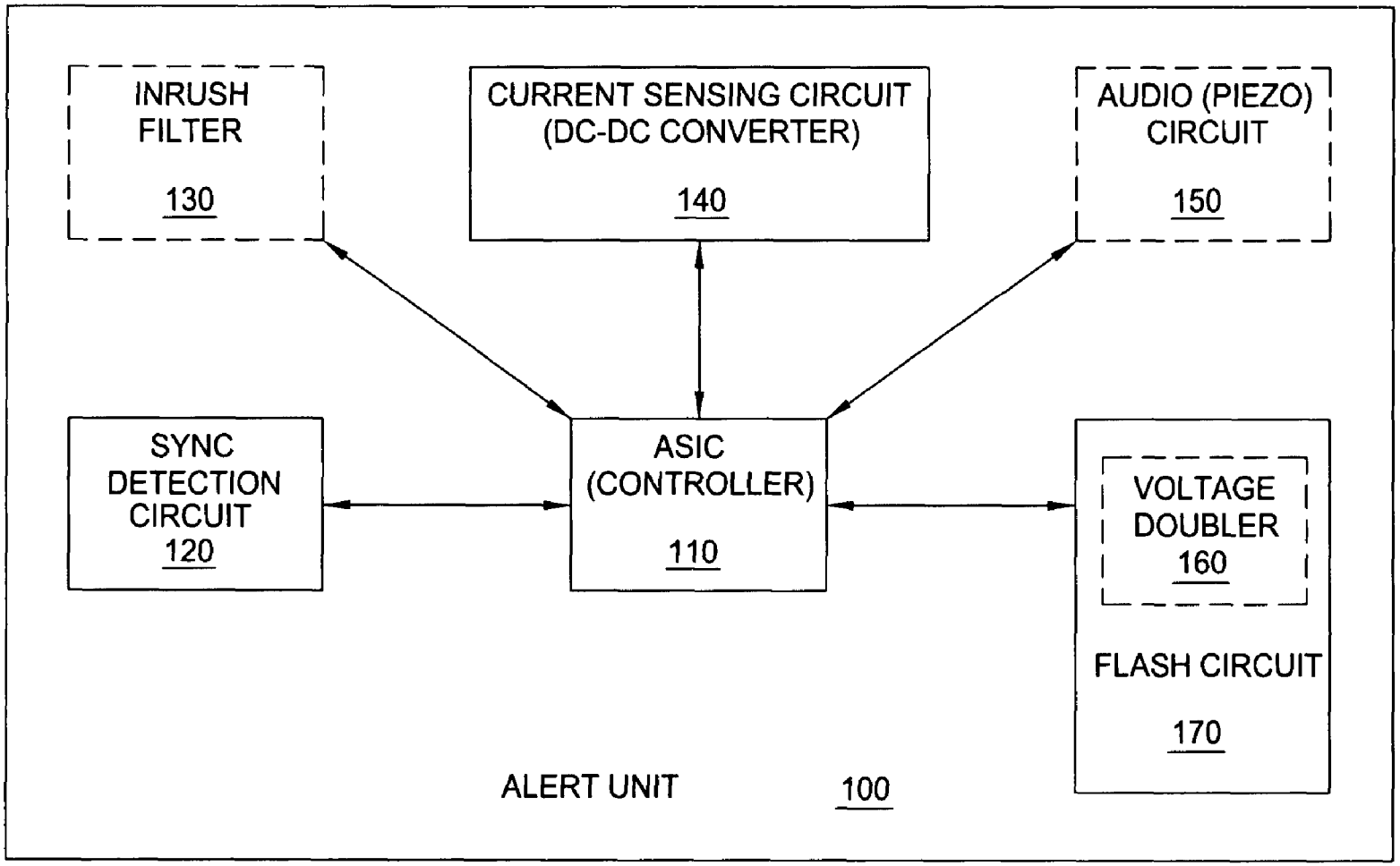
FIG. 1 illustrates a block diagram of an alarm unit of the present invention.

FIG. 1 depicts a block diagram of an exemplary ASIC controlled alarm or alert unit 100 of the present invention. The alert unit 100 comprises an ASIC 110 serving the functions of a controller, a synchronization detection circuit 120, an inrush filter or current limiting circuit 130, a current sensing circuit 140, an audio circuit 150, and a flash circuit 170 having an optional voltage doubler 160. It should be understood that although one embodiment of the present invention is directed toward providing an alarm unit with a selectable strobe intensity feature, the present invention can be deployed in a strobe alarm unit without the selectable strobe intensity feature or even an alarm unit having only audio warning capability.

In brief, the alarm unit 100 is generally powered by a supply voltage of 12 volts or 16-33 volts, and such supply voltage may be either D.C. supplied by a battery or a full-wave rectified voltage. In one embodiment of the present invention, the ASIC 110 functions as a controller and serves to control and regulate various functions of the alarm unit.

For example, the ASIC 110 serves to control the audio circuit 150 for generating an audio warning, e.g., via a horn, buzzer and the like. The ASIC 110 can control and regulate various audible features such as the frequency of the audio warning, e.g., to generate a Code 3 audio pattern. It should be noted that the audio circuit 150 shown in a dashed box can be optionally omitted if the alarm unit is implemented as a strobe only alarm unit.

The inrush filter (or current limiting circuit) 130 serves to limit the effect of an inrush condition. Inrush is a condition that may occur upon initial power-on, where a higher than average current is present in the alarm unit when power is applied to the power terminals for the first time to start alarm notification. Inrush can cause a momentary overload in the power supply and may cause the overcurrent protection in the panel to activate which can prevent the alarm units from operating. The overload may also damage relay contacts located in the panel which switch the loop to an alarm condition. Similarly, the inrush filter 130 shown in a dashed box can be optionally omitted if the inrush condition is not present or is addressed outside of the alarm unit.

The current sensing circuit 140 assists in detecting peak current condition. This circuit assists in converting the input voltage, e.g., 24 volts, to a voltage, e.g., 125-250 volts, sufficient to fire the flashtube within the flash circuit 170.

In one embodiment of the present invention, the alarm unit incorporates a switch having a plurality of positions, e.g., four positions that are representative of a plurality of intensity settings. By setting the switch to a particular position, the alarm unit will produce a predefined intensity level associated with that particular switch position. For example, setting the switch to a 110 candela setting will cause the alarm unit to produce a flash having a light output intensity of at least 110 candela upon activation of the alarm unit. The switch is coupled to an actuator assembly (not shown) and disposed within the alarm unit housing such that the switch is tamper resistant after installation, while the selected intensity setting is still clearly visible for inspection. The novel actuator assembly and associated display or menu is disclosed in U.S. Pat. No. 6,411,201, which is herein incorporated by reference.

In turn, the flash circuit 170 includes the voltage doubler 160 that serves the function of presenting a voltage across the flashtube that is twice the actual voltage that is stored in a storage capacitor, thereby allowing the flashtube to reliably fire at lower voltages. The importance of the voltage doubler 160 is due to the fact that the alarm unit may provide the selectable multi-candela feature. This feature places a difficult constraint on the circuitry of the alarm unit in that different voltages must be presented across the flashtube. Namely, the flashtube will be fired by a voltage that is dictated by a particular intensity level setting. As such, since the alarm unit is expected to produce intensity levels ranging widely from 15-110 candela, the alarm unit must reliably operate with relatively low voltages stored on a single storage capacitor. Without the reliability provided by the voltage doubler 160, multiple storage capacitors with additional switching will be required, especially when the selectable multi-candela feature offers a wide range of intensity levels. More specifically, the voltage doubler 160 allows the alarm unit of the present invention to reliably offer a selectable multi-candela feature that offers four (4) candela settings that widely ranges from 15 to 110 candela. The ability to offer a wide range of candela settings serves to eliminate more models of alarm units.

Figure 2:
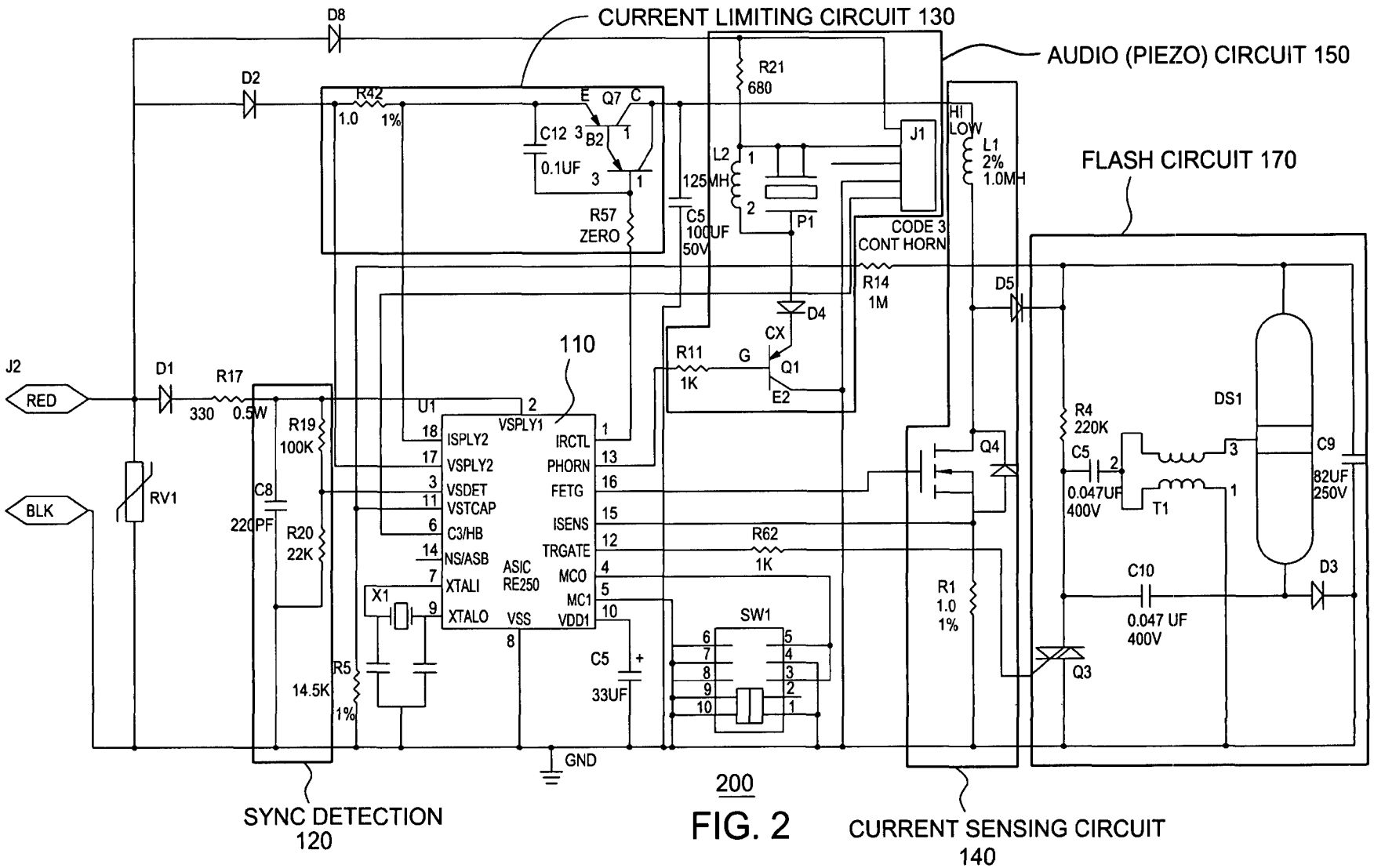
FIG. 2 illustrates a circuit diagram of one embodiment of an alarm unit employed in the present invention.
Figure 3:
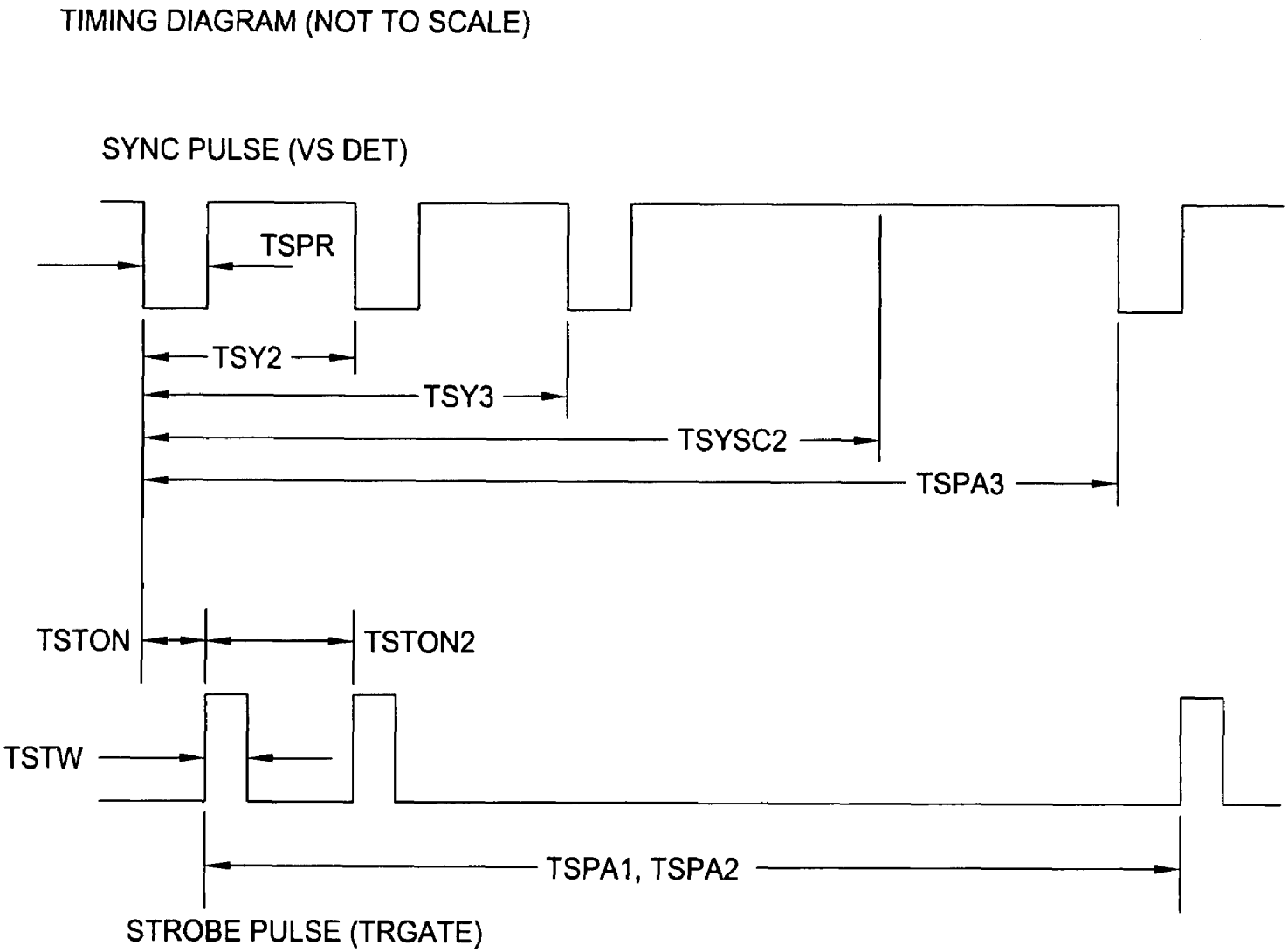
FIG. 3 illustrates a timing diagram of the present invention.

FIG. 2 is a detailed exemplary circuit diagram of one embodiment of an alarm unit employed in the present invention. To the extent possible and to assist the reader, the components within FIG. 2 will be described and grouped in accordance with the block diagram of FIG. 1, i.e., described within the context of a particular circuit of FIG. 1. However, those skilled in the art will realize that this grouping scheme is based on the functions provided by the collective components and should not be interpreted as limiting a particular component to a particular circuit. For example, a particular component may serve multiple functions or a component may serve support functions that are not broadly described in FIG. 1.

Additionally, the various circuits described in FIG. 1 should not be interpreted that these circuits must be implemented as separate modules or circuits. For example, the voltage doubler 160 can be implemented outside of the flash circuit 170 or can be logically grouped as part of another circuit.

FIG. 2 illustrates an exemplary embodiment of the present invention. The application circuit 200 is for a horn-strobe alarm unit. The strobe can operate continuously when connected directly to a continuous DC or FWR voltage source, or can provide a synchronized strobe signal when used in conjunction with a synchronization module or a power booster. This device provides four selectable output intensities in one unit (15 cd, 30 cd, 75 cd & 110 cd).

Figure 6:
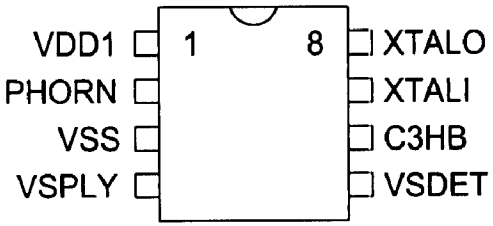
FIG. 6 illustrates an eight pin DIP package of the ASIC of the present invention.
Figure 5:
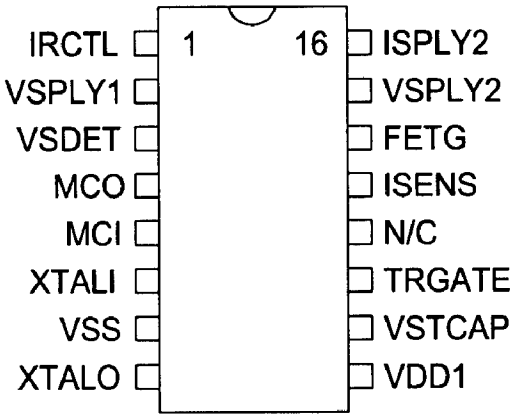
FIG. 5 illustrates a sixteen pin DIP package of the ASIC of the present invention.
Figure 4:
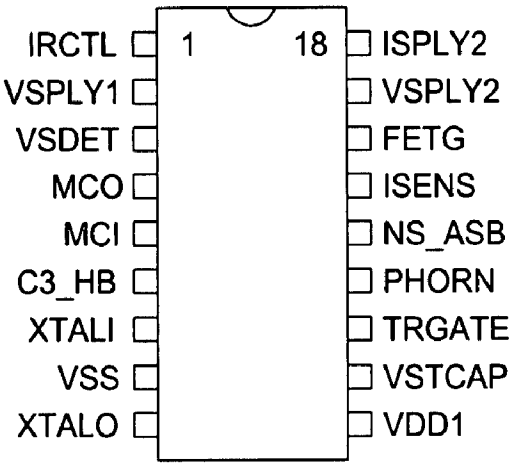
FIG. 4 illustrates an eighteen pin DIP package of the ASIC of the present invention.

The application circuit 200 employs an ASIC 110 as a controller. Several embodiments of the ASIC are disclosed below, e.g., an 18-pin package (as shown in FIG. 4), a 16-pin package (as shown in FIG. 5) and an 8-pin package (as shown in FIG. 6). Several tables are provided below to illustrate the specification of various ASIC embodiments. However, those skilled in the art will realize that the ASIC 110 can be deployed in accordance to other requirements.

TABLE 1

Absolute Maximum Ratings

| Description | Parameter | Max | Units |
|---|---|---|---|
| Supply Voltage | VSPLP1 | 50 | V |
| Supply Voltage | VDD1 | 10.5 | V |
| Logic Input Voltage | Note 1 | −0.3 to Vdd1 + 0.3 | V |
| Input Current (lin) | Note 1 | ±0.010 | A |
| Operating Temperature | Ta | −40 to 85 | ° C. |
| Storage Temperature | Ts | −55 to 150 | ° C. |
| Power Dissipation | PD | 700 | mW |

NOTE:

1. Logic inputs are MC0, MC1, NS_ASB and C3_HB.

TABLE 2

Pin Definitions

| 18 PDIP PIN# | 16 PDIP PIN# | PIN NAME | TYPE | DESCRIPTION |
|---|---|---|---|---|
| 1 | 1 | IRCTL | Output | This opamp output pin drives the base of an external darlington PNP transistor and limits the peak current to the strobe supply, based on the candela setting and the Vsply2 and Isply2 differential voltage. |
| 2 | 2 | VSPLY1 | (+) Supply | This is most positive supply pin. This supply can be 12 or 24 nominal DC or a unfiltered full-wave-rectified voltage of 12 Vrms or 24 Vrms. |
| 3 | 3 | VSDET | Input | This input is connected to a resistive divider connected to the VSTRB supply. This input is used to detect sync pulses on VSTRB and the presence of a full-wave-rectified supply. |
| 4 | 4 | MC0 | Input | This input in conjunction with MC1 selects 1 of 4 candela settings. This input has an internal pull up to the logic supply voltage. |
| 5 | 5 | MC1 | Input | This input in conjunction with MC0 selects 1 of 4 candela settings. This input has an internal pull up to the logic supply voltage. |
| 6 | N/A | C3_HB | Input | This input selects either a Code 3 horn temporal pattern (input low) or continuous horn pattern (input high). This pin has an internal pull up to the logic supply. |
| 7 | 6 | XTALI | Input | Input of an inverting amplifier for use with an external 4 MHZ ceramic resonator and start up capacitor. |
| 8 | 7 | VSS | (−)Supply | Negative supply voltage. |
| 9 | 8 | XTALO | Output | Output of an inverting amplifier for use with an external 4 MHZ ceramic resonator and start up capacitor. |
| 10 | 9 | VDD1 | Output | This is the output of the most positive on chip regulated supply voltage. |
| 11 | 10 | VSTCAP | Input | This input is connected to a resistive divider connected to the strobe capacitor. This input is used to sense the voltage on the strobe capacitor. |
| 12 | 11 | TRGATE | Output | This complementary output drives the gate of an external triac, which flashes the strobe. |
| 13 | N/A | PHORN | Output | This complementary output drives the base of an NPN transistor at the specified frequencies, based on the status of the AS_NSB input. The NPN drives one plate of a piezo electric horn. |
| 14 | N/A | NS_ASB | Input | This input selects either the NS (input high) or AS (input low) horn tones. |
| 15 | 13 | ISENS | Input | Input to a comparator for sensing the current through the external NFET. |
| 16 | 14 | FETG | Output | This complementary output drives the gate of an external NFET. This NFET switches the inductor of the DC to DC converter for generation of the high voltage required for strobe operation. |
| 17 | 15 | VSPLY2 | Input | Error amplifier input from the unfiltered strobe supply voltage. |
| 18 | 16 | ISPLY2 | Input | Error amplifier input from current sense resistor in the unfiltered strobe supply voltage. |

Electrical Specifications:

TABLE 3

ELECTRICAL SPECIFICATIONS

| Parameter | Description | Test Pin* | Test Conditions | Typical Value | Unit |
|---|---|---|---|---|---|
| Vsply1 | Supply Voltage | VSPLY1 | | 8-48 | V |
| Idd | Supply Current | VSPLY1 | VSPL1 = 16-33 Vdc | 3 | mA |
| Vdd1 | FETG Supply Voltage | VDD1 | VSPL1 = 16-33 Vdc | 7.3-10.25 | V |
| Vdd | Logic Supply Voltage | N/A | VSPL1 = 16-33 Vdc | 5 | V |
| Por | Power On Voltage | VSPLY1 | | 3.0-3.8 | V |
| Vsdet-il | Sync Detect Low Input | VSDET | | Vss-0.9 | V |
| Vsdet-ih | Sync Detect High Input | VSDET | | 1.1-Vdd1 | V |
| Vil | Input Logic Low Level | Note 2 | | 1.5 | V |
| Vih | Input Logic High Level | Note 2 | | 3.5 | V |
| Ipu | Input Pull Up Current | Note 2 | Vin = 0 V | −100 | μA |
| Ioh | Output High Source Current | PHORN | Vout = Vdd-0.5 v | −4.5 | mA |
| | | TRGATE | Vout = Vdd-0.5 v | −4.5 | mA |
| | | FETG | Vout = VDD1-0.5 | −9 | mA |
| Iol | Output Low Sink Current | PHORN | Vout = 0.5 V | 5 | mA |
| | | TRGATE | Vout = 0.5 V | 5 | mA |
| | | FETG | Vout = 0.5 V | 9 | mA |
| Ivsply2 | Supply Current Test | VSPLY2 ISPLY2 | Vin = 48 v V(Isply2) = 48 v | 2.0 | mA |
| Vstcap-l | Storage Capacitor Low Input | VSTCAP | | Vss-1.8 | V |
| Vstcap-h | Storage Capacitor High Input | VSTCAP | | 2.2-Vdd1 | V |
| Vr16dc1 | Current Sense Voltage References at 16 Vdc DC mode $T_A$ = 25° C. | ISENS | MC0 = low MC1 = low | 274 | mV |
| Vr16dc2 | | | MC0 = high MC1 = low | 358 | mV |
| Vr16dc3 | | | MC0 = low MC1 = high | 493 | mV |
| Vr16dc4 | | | MC0 = high MC1 = high Vsply = 16 Vdc Vsdet = 2.8 Vdc | 582 | mV |
| Vr24dc1 | Current Sense Voltage References at 24 Vdc DC mode $T_A$ = 25° C. | ISENS | MC0 = low MC1 = low | 257 | mV |
| Vr24dc2 | | | MC0 = high MC1 = low | 340 | mV |
| Vr24dc3 | | | MC0 = low MC1 = high | 473 | mV |
| Vr24dc4 | | | MC0 = high MC1 = high Vsply = 24 Vdc Vsdet = 4.2 Vdc | 558 | mV |
| Vr33dc1 | Current Sense Voltage References at 33 Vdc DC mode $T_A$ = 25° C. | ISENS | MC0 = low MC1 = low | 238 | mV |
| Vr33dc2 | | | MC0 = high MC1 = low | 320 | mV |
| Vr33dc3 | | | MC0 = low MC1 = high | 449 | mV |
| Vr33dc4 | | | MC0 = high MC1 = high Vsply = 33 Vdc Vsdet = 5.8 Vdc | 529 | mV |
| Vr16rms1 | Current Sense Voltage References at 16 Vdc FWR mode $T_A$ = 25° C. | ISENS | MC0 = low MC1 = low | 256 | mV |
| Vr16rms2 | | | MC0 = high MC1 = low | 340 | mV |
| Vr16rms3 | | | MC0 = low MC1 = high | 471 | mV |
| Vr16rms4 | | | MC0 = high MC1 = high Vsply = 16 Vdc Vsdet = 4.4 Vdc | 572 | mV |
| Vr24rms1 | Current Sense Voltage References at 24 Vdc FWR mode TA = 25° C. | ISENS | MC0 = low MC1 = low | 231 | mV |
| Vr24rms2 | | | MC0 = high MC1 = low | 313 | mV |
| Vr24rms3 | | | MC0 = low MC1 = high | 441 | mV |
| Vr24rms4 | | | MC0 = high MC1 = high Vsply = 24 Vdc Vsdet = 6.7 Vdc | 533 | mV |
| Vr33rms1 | Current Sense Voltage References at 24 Vdc FWR mode $T_A$ = 25° C. | ISENS | MC0 = low MC1 = low | 210 | mV |
| Vr33rms2 | | | MC0 = high MC1 = low | 291 | mV |
| Vr33rms3 | | | MC0 = low MC1 = high | 416 | mV |
| Vr33rms4 | | | MC0 = high MC1 = high Vsply = 33 Vdc Vsdet = 8.4 Vdc | 501 | mV |
| IsensTC | Current Sense Voltage Temperature Coefficient | Isens | −40-85° C. | 0.02 | %/° C. |
| Isplim1 | Vsply Current Limit | VSPLY2-ISPLY2 | MC0 = low MC1 = low | 260 | mA |
| Isplim2 | | | MC0 = high MC1 = low | 440 | mA |
| Isplim3 | | | MC0 = low MC1 = high | 800 | mA |
| Isplim4 | | | MC0 = high MC1 = high | 1080 | mA |

NOTES:

1. All tests to be performed at ambient to temperature guardbanded limits.
2. Logic inputs are MC0, MC1, NS_ASB and C3_HB.

AC Electrical Characteristics[1] at $T_A$=−40 C to 85 C, $V_{DD1}$=9.5V, Vsply1=24 Vdc, V ss=0V, Y1=4 MHz+−1% resonator and typical application in FIG. 1 and timing diagram, below (unless otherwise noted). Test pins are for 18 pin package.

TABLE 4

| Parameter | Description | Test Pin* | Test Conditions | Typical Value | Unit |
|---|---|---|---|---|---|
| Tfetho | FETG initial hold-off (after clock startup) | FETG | Y1 = 4 MHz Resonator, time after clk startup | 50 | mS |
| Tper | Strobe PWM Period | FETG | Y1 = 4 MHz Resonator | 60 | μS |
| Trise | Voltage Rise Time (from 10% to 90%) | FETG | with 200 pF load cap | 100 | nS |
| | | | with 1000 pF load cap | 400 | |
| Tfall | Voltage Fall Time (from 90% to 10%) | FETG | with 200 pF load cap | 100 | nS |
| | | | with 1000 pF load cap | 400 | |
| Tsypr | Sync Pulse Recognition Time | VSDET | SYNC Mode | 4.9-6.1 | mS |
| Tston | Strobe Pulse On Delay | TRGATE-VSDET | SYNC Mode | 25.5 | mS |
| Tstw | Strobe Pulse Width (Triac) | TRGATE | AUTO Mode | 10 | mS |
| Tston2 | Strobe Pulse Retrigger | TRGATE | VSTCAP = High | 70 | mS |
| Tspa1 | Strobe Period if no Sync Pulse is detected. (SYNC to AUTO) | TRGATE | Start in SYNC Mode, then switch to AUTO. | 1100 | mS |
| Tspa2 | Strobe Period for AUTO Mode | TRGATE | AUTO Mode | 975 | mS |
| Ttmto | Test-Mode Auto Time Out | TRGATE | Test Mode | 7.07 | mS |
| Tspr[2] | Sync Pulse Width | VSDET | | 25 | mS |
| Tsy2 | $2^{nd}$ Sync Pulse For Horn SILENCE | VSDET | | 100 | mS |
| Tsy3 | $3^{rd}$ Sync Pulse For Horn Enable | VSDET | | 200 | mS |
| TsyRep[2] | Repeat Rate for $2^{nd}$ or $3^{rd}$ Sync Pulse | VSDET | | 4 | S |
| Tsysc2 | Start of next Sync Pulse Scan | VSDET | | 500 | mS |
| Tspa3[2] | Strobe Period for SYNC Mode | TRGATE | SYNC Mode | 990 | mS |
| Asfreq | AS Output Freq | PHORN | NS_ASB = Low | 3500 | Hz |
| Nsfreq | NS Output Freq | PHORN | NS_ASB = High | 3040 | Hz |
| Aston | AS Pulse On Time | PHORN | NS_ASB = Low | 120 | μS |
| Nston | NS Pulse On Time | PHORN | NS_ASB = High | 115 | μS |
| Assweep | AS Freq Sweep Rate | PHORN | NS_ASB = Low | 109.5 | Hz |
| Nssweep | NS Freq Sweep Rate | PHORN | NS_ASB = High | 117 | Hz |
| Tc3on[3] | Code 3 Horn On Time (cycle 1, 2, 3) | PHORN | C3_HB = Low | 488 | mS |
| Tc3off | Code 3 Horn Off Time (cycle 1, 2, 3) | PHORN | C3_HB = Low | 488 | mS |
| Tc3off4[3] | Code 3 Horn Off Time (cycle 4) (no horn burst) | PHORN | C3_HB = Low | 975 | mS |
| FWRfreq[2] | Full Wave Rectified Frequency | | | 120 | Hz |

NOTES:

1. All tests are to be performed at ambient to temperature guardbanded limits.

[2]Parametric condition for test, not result of ASIC behavior; ASIC has no control of this input parameter.

[3]Additional conditions: Auto Mode or Sync Mode with Tspa3 condition.

Functional description is now provided for the application circuit 200. The function description discloses several operational advantages offered by the ASIC 110.

Startup FETG Hold-Off

At startup, the FETG output is held low for 50 ms. This creates a 20 ms window of time after the Trgate (initially high) is turned off and the inrush clamp circuit is turned on, and before the FETG output is turned on. The 20 ms allows the storage cap (C3) to charge up before operating the dc-dc voltage booster.

Sync Pulse Detection

The sync pulse detection and control circuit detects sync pulses, and controls and synchronizes strobe and horn function. The Sync Pulse detection circuit will recognize a Sync Pulse if the voltage drops to a logic low on Vsdet for more than 6 ms.

Sound Control

The sound control circuit controls whether the horn is silent, running continuously, or operating in code 3 mode. The horn operates in code 3 mode whenever either the C3_HB input is low (with jumper plug installed) or a sync pulse has been detected within the last 1 second. When in Code 3 mode, the horn is silent 20 ms before to 480 ms after the strobe pulse; the horn will sound 480 ms after the Strobe Pulse, and be silenced again either when a sync pulse is detected or 20 ms before the next strobe pulse. It will sound for about ½ second, with ½ second pause, three times; then it will remain silent for an additional second, and then repeat the pattern.

If Code 3 is low, the horn will always run in code 3 mode. At initial power on, there is a delay of approximately 0.5 seconds before the first horn burst.

If the Code 3 input is high, the horn will only run continuously when no sync pulses are sent. At initial power on, the horn will start within 25 milliseconds.

If a second Sync Pulse is sent between 60 ms and 140 ms after the first, the horn will be silenced. This will also halt the count of the Code 3 pattern, so that when sound is re-enabled the pattern will pick up where it left off. If a second Sync Pulse is sent between 160 ms and 240 ms after the first, the horn will sound again and silence will end. The horn defaults to sounding on power-up.

Strobe Control

The strobe is fired when the ASIC receives a strobe sync pulse, or automatically every 975 ms when operating under auto mode. The auto mode causes the strobe to flash between predefined time intervals without the need to receive a strobe sync pulse. The auto mode can be entered in the event that a synchronization module fails to provide strobe sync pulses to the alarm units.

The strobe is also re-triggered if the strobe capacitor is still high after the strobe is turned off. With each strobe trigger, the current limiting transistor is switched off to protect against "after-glow" of the flashtube.

A sync pulse is recognized as a strobe sync pulse if it is either the first sync pulse, or if more than 500 ms has elapsed since the last strobe sync pulse. When a strobe sync pulse is received the strobe is fired after a delay of 20 ms. Additionally the ASIC goes into sync mode. In sync mode, the ASIC waits for another strobe sync pulse for up to 1.1 seconds. After 1.1 seconds the ASIC automatically strobes and falls in auto mode. Upon receiving a sync pulse, the strobe charging circuit (oscillator) is switched off to conserve power while the input voltage is low.

In auto mode, the ASIC automatically strobes every 975 ms. A sync pulse at any time in the cycle will cause the part to strobe and go into sync mode. This is the default mode if no sync pulses are detected.

In sync mode or auto mode, if the strobe capacitor is still charged after the first strobe output has gone high and low, then the strobe output will be re-triggered after 60 ms.

Over-Voltage Protection

The over-voltage protection circuit detects whether the strobe capacitor has been discharged after a trigger pulse. If the strobe is not discharged, FETG is held off to prevent further charging. In a normal cycle, the strobe capacitor (signal Vstcap) is checked during a window of 10-20 ms after the strobe is triggered. If the capacitor is still charged at this point, then a second trigger pulse will occur 60 ms after the first strobe trigger goes low. If, after the second pulse, the strobe capacitor is still charged, the ASIC enters an over-voltage condition.

The over-voltage condition ends when the strobe capacitor is discharged, when Vstcap is low. This condition only becomes effective during the silence pulse window (20-120 ms after the first strobe, regardless of sync or auto mode). This allows nearly a full cycle to charge up the strobe capacitor.

One important advantage of the ASIC-controlled alarm unit is that it provides better voltage and current monitoring functions. For example, the ASIC offers more precise control of the strobe circuit. In one embodiment, the energy level of the strobe is controlled by the voltage level on the sense resistor R1 that goes to the ISENSE pin on the chip. This level is trimmed during the chip manufacturing process and is set within a much tighter tolerance limit compared to the micro/opto circuit. The micro/opto circuit relies on the tolerance of the forward voltage of the diode in the optocoupler and is less precise.

In another embodiment, the ASIC circuit has a more advanced peak current limiting circuit. Micro/opto circuit generally limits the initial peak current only during the initial power-up stage. The present ASIC circuit continuously senses the input current level and will limit the current any time it rises above a set level. The clamp level is determined by the voltage level on a resistor R42 which is sensed by the ASIC, and the level can be changed by changing the sense resistor. This is an actively controlled current-limiter compared to other current-limiting schemes that use a passive foldback-type configuration.

Horn Tone Generation

The horn tone (on the PHORN output) is generated by producing two cycles of each frequency specified in either the NS or AS table shown below. The tone starts at the highest frequency and after two cycles is decremented until the minimum frequency is reached, producing two cycles at each frequency. The frequency is then incremented until the maximum frequency is reached again producing 2 cycles at each frequency. This sweep frequency is then repeated as long as the horn tone is enabled. This results in a sweep frequency of 117 HZ for the NS tone and 109.5 for the AS tone.

For the AS horn tone the on time at each frequency is fixed at 120 uS. For the NS horn tone the on time at each frequency is fixed at 115 uS.

The logic state of the pin NS_ASB determines which tone is selected. If NS_ASB is high or open the NS tone is selected. The AS tone is selected if NS_ASB is low. Thus, the ASIC-based architecture allows the selection of either NS tone or AS tone, i.e., providing the ability to select a particular horn tone frequency.

This approach in implementing the horn tone generation via an ASIC provides a reduction in the number of components that are deployed. For example, prior implementations deploy two integrated circuits to provide this function.

Horn Frequency Table

TABLE 5

| | AS Horn Tone (HZ) | NS Horn Tone (HZ) |
|---|---|---|
| High | 3802 | 3215 |
| | 3759 | 3185 |
| | 3717 | 3155 |
| | 3676 | 3125 |
| | 3636 | 3096 |
| | 3597 | 3067 |
| | 3559 | 3040 |
| | 3521 | 3012 |
| | 3484 | 2985 |
| | 3448 | 2959 |
| | 3413 | 2933 |
| | 3378 | 2907 |
| | 3344 | 2882 |
| | 3311 | |
| | 3279 | |
| Low | 3247 | |

Test Mode

The ACIC has a special mode for measuring the ASIC during fabrication testing. In this mode, the strobe cycle is sped up by a factor of 4000, such that 1 ms is reduced to a single ¼ μs clock. The entrance into this test mode has been designed to avoid accidental triggering. The entrance algorithm requires cycling through a count of 0-3 on MC0 and MC1 (where MC1 is the MSB) twice. This must be done in 4 μs steps and must match precisely to a ¼ μs clock. As a result, the entrance algorithm requires 32 μs of precisely matching inputs on MC0 and MC1 for each and every ¼ μs clock, making accidental entrance very unlikely. This entrance algorithm is synchronous; moving the MC0 and MC1 inputs will not bypass any steps to the entrance algorithm. Furthermore, a timeout has been added such that if the part does accidentally enter test mode it will time out in at most 7 ms (29 strobe cycle timeouts in test mode), as denoted by the spec parameter Ttmto. At this point, it will resume operation in auto mode.

Non-ASIC Specifications:

TABLE 6

| NS Horn Current Ratings (AMPS)* Average Current | | |
|---|---|---|
| Voltage | Hi dBA Setting | Low dBA Setting |
| 16.0 VDC | 0.019 | 0.012 |
| 24.0 VDC | 0.028 | 0.015 |
| 33.0 VDC | 0.039 | 0.018 |
| 16.0 VRMS | 0.029 | 0.016 |
| 24.0 VRMS | 0.044 | 0.019 |
| 33.0 VRMS | 0.061 | 0.022 |

TABLE 7

| RSS Current Ratings (AMPS)* | | | | |
|---|---|---|---|---|
| Voltage | 15 cd | 30 cd | 75 cd | 110 cd |
| Average Current | | | | |
| 16.0 VDC | 0.062 | 0.100 | 0.189 | 0.261 |
| 24.0 VDC | 0.041 | 0.063 | 0.113 | 0.149 |
| 33.0 VDC | 0.030 | 0.047 | 0.081 | 0.104 |
| 16.0 VRMS | 0.102 | 0.162 | 0.282 | 0.364 |

TABLE 7-continued

| RSS Current Ratings (AMPS)* | | | | |
|---|---|---|---|---|
| Voltage | 15 cd | 30 cd | 75 cd | 110 cd |
| 24.0 VRMS | 0.071 | 0.114 | 0.186 | 0.239 |
| 33.0 VRMS | 0.059 | 0.090 | 0.148 | 0.198 |
| Peak/Inrush Current | | | | |
| 16.0 VDC | 0.248 | 0.400 | 0.756 | 1.044 |
| 24.0 VDC | 0.248 | 0.400 | 0.756 | 1.044 |
| 33.0 VDC | 0.248 | 0.400 | 0.756 | 1.044 |
| 16.0 VRMS | 0.248 | 0.400 | 0.756 | 1.044 |
| 24.0 VRMS | 0.248 | 0.400 | 0.756 | 1.044 |
| 33.0 VRMS | 0.248 | 0.400 | 0.756 | 1.044 |

*Current draw numbers are for reference only.

TABLE 8

| Nominal Strobe Energy Ratings (J) | | | | |
|---|---|---|---|---|
| Candela | 15 cd | 30 cd | 75 cd | 110 cd |
| Energy | 0.66 | 1.05 | 1.80 | 2.35 |

TABLE 9

| Strobe Efficiency (%) (Typical) | | | | |
|---|---|---|---|---|
| Voltage | 15 cd | 30 cd | 75 cd | 110 cd |
| 16.0 VDC | 75 | 71 | 67 | 65 |
| 24.0 VDC | 77 | 77 | 74 | 73 |
| 33.0 VDC | 76 | 77 | 76 | 75 |

NOTES:
1. All DC Sync Strobes will operate on either pure DC or full-wave-rectified voltage.
2. Performance ratings are at nominal input voltage, except where specified.
3. Tolerances: Average Current: −30%, +0%. Peak Current: −80%, +0%.
4. Strobe flash rate over voltage range: 1.010-1.035 Hz without sync module, 1.000-1.020 Hz with sync module.

FIG. 7 illustrates a circuit diagram of one embodiment of an alarm unit employed in the present invention. Various features of the alarm unit 700 are disclosed below. More specifically, detailed descriptions are provided for the inrush current or current limiting circuit 130 and the current sensing circuit 140 (i.e., the strobe DC to DC boost converter). It should be noted that the circuit diagram of FIG. 7 does not show the audio control and output circuit.

Inrush Current Limiting Circuit

The inrush limiting circuit 130 limits input current through Q7. The current is sensed across resistor R42. When the voltage across R42 matches an internal voltage reference V1, transistor Q7 is turned off by an operational amplifier. The voltage reference has 4 settings selectable by 2 digital inputs MC0 and MC1, such that each candela energy setting has a different inrush limit. It should be noted that although not shown in the diagram, at initial power up the inrush is limited to the lowest setting, to reduce power loading transistor Q7.

Additionally, strobe afterglow is prohibited by turning off the transistor Q7 during a strobe. One common method to prevent strobe afterglow is by using a limiting resistor, but such approach creates efficiency losses in that same resistor. As a result, the present novel ASIC-based approach of controlling/disabling inrush current improves strobe efficiency by removing losses of a limiting resistor and preventing flash tube afterglow.

Strobe DC-DC Boost Converter Circuit

The DC-DC boost converter circuit allows for accurate energy charging of a storage capacitor. Typically high voltage capacitors are not very accurate in terms of capacitance value (e.g., ±20%). As such, measuring the voltage on the capacitor is not an accurate method of determining the energy stored on it. Alternatively, another method to measure stored energy is to put a fixed amount of energy in. Since inductors and resistors are more accurately specified, they can be used to more accurately quantify the energy stored.

The DC-DC boost converter accurately stores energy based on a fixed inductance (L1), and a precisely set peak current. The inductor charge cycle begins every 60 μs, by turning on transistor MQ4. Current and energy increase through the inductor L1. When, the voltage across the sense resistor R1 reaches and equals the internal voltage reference, the transistor MQ4 is latched off, until the next charge cycle. The voltage reference has 4 settings for 4 energy levels, controlled by 2 digital inputs MC0 and MC1. This voltage reference is trimmed for accuracy, so as to set a peak voltage/current accurate to ±2%.

Further, the sense voltage (and therefore the inductor L1 peak current) required is adjusted based on the supply voltage so as to keep the energy charged constant over supply voltage. This is accomplished by means of the resistor dividers R19/R20 and R2*a/b*. The ASIC also detects a DC or full wave rectified power supply and adjusts the energy charged accordingly. The resistor divider R2*a/b* has 4 settings to correspond with the 4 energy settings, such that energy is kept flat over supply voltage on each energy setting.

The 60 μs (~16 kHz) charge cycle is faster than the typical strobe charge cycle (8 kHz or less). This results in the benefits of a strobe that is quieter (16 kHz is not typically audible), and a boost inductor has a lower inductance (and is therefore smaller and cheaper).

Another improvement is the driver for the gate of transistor MQ4. This driver is high voltage, and runs at 9.5 v typically, which provides a greater Vgs to MQ4 so that it has a lower effective $R_{ON}$, and therefore providing greater drive current than a typical 5V logic output. The result is faster switching times (>200 ns vs. ~1 μs for an IRF710). Both of these improvements increase the efficiency of the DC-DC boost conversion by reducing losses in the transistor MQ4.

The DC-DC converter also has an over voltage protection feature. In the case that the strobe capacitor C9 does not discharge after a strobe signal is enabled, the DC-DC boost converter is turned off (MQ4 is held off) until the strobe capacitor is discharged and prevents an over voltage condition on the strobe capacitor.

Figure 8:
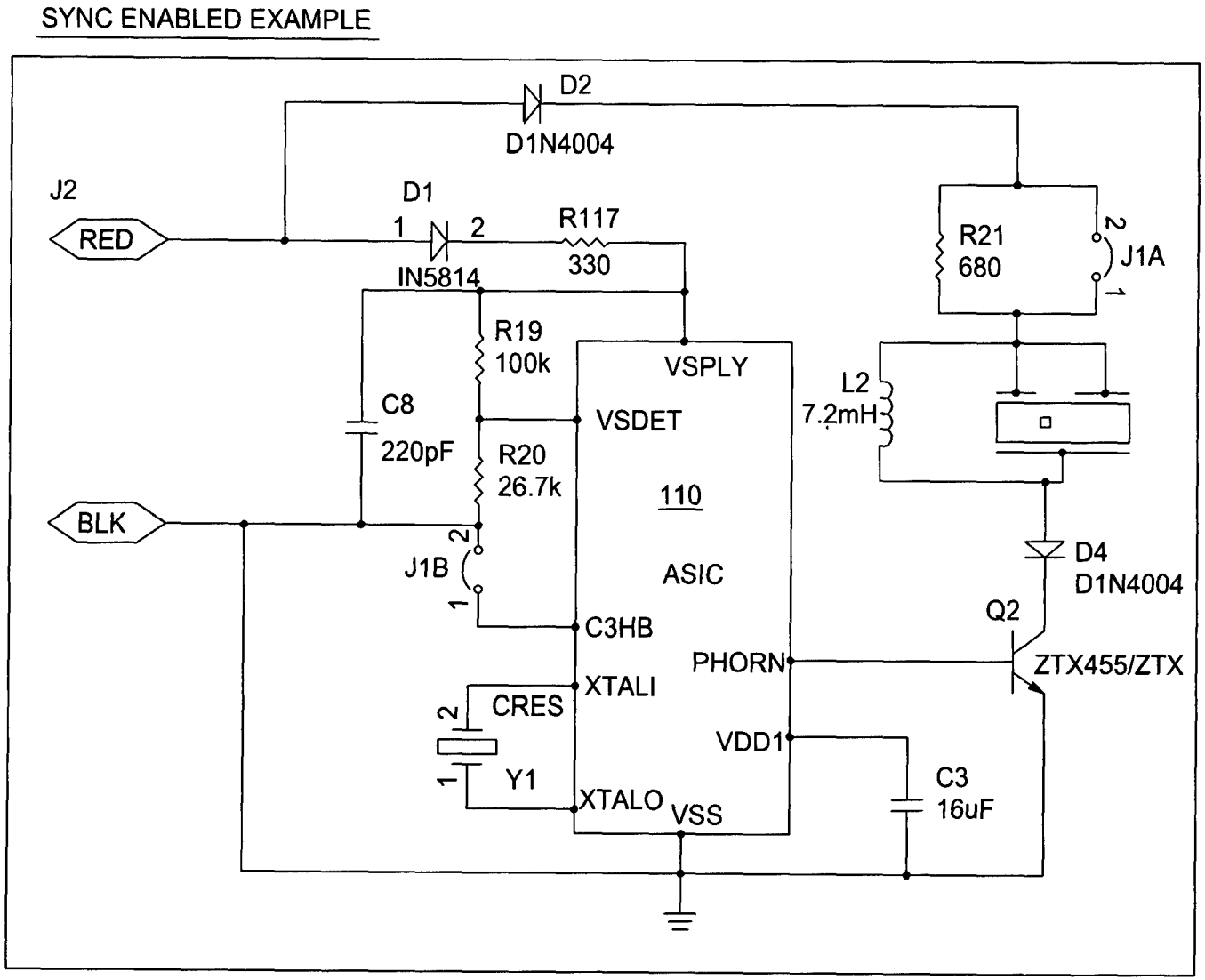
FIG. 8 illustrates a circuit diagram of one embodiment of an alarm unit employed in the present invention.

FIG. 8 illustrates a circuit diagram of one embodiment of an alarm unit 800 employed in the present invention. FIG. 8 illustrates an ASIC 110 implemented in an eight-pin package. Various features of the alarm unit 800 are disclosed below.

In one embodiment, the value of R20 (26.7 k) has been adjusted for optimal Vsply operation. The value (e.g., from 20 k-27K) should be selected to allow for 8 v operation to still register as a high on Vsdet (>1.2 v, for safety margins). However, the resistor divider voltage should not get too high so as to exceed the maximum input voltage of Vdd1+0.3 v (typically 9.8 v). The values selected were chosen to go as high as is safe for the Vsdet input.

If there is still difficulty at low voltage operation, a forward biased diode (0.3 v<Vd<=0.75 v) could be added in series with R20, and R20 can be adjusted to 20 k. This is to ensure that the ASIC detects the power supply to be on normally, and off during a sync pulse.

Figure 9:
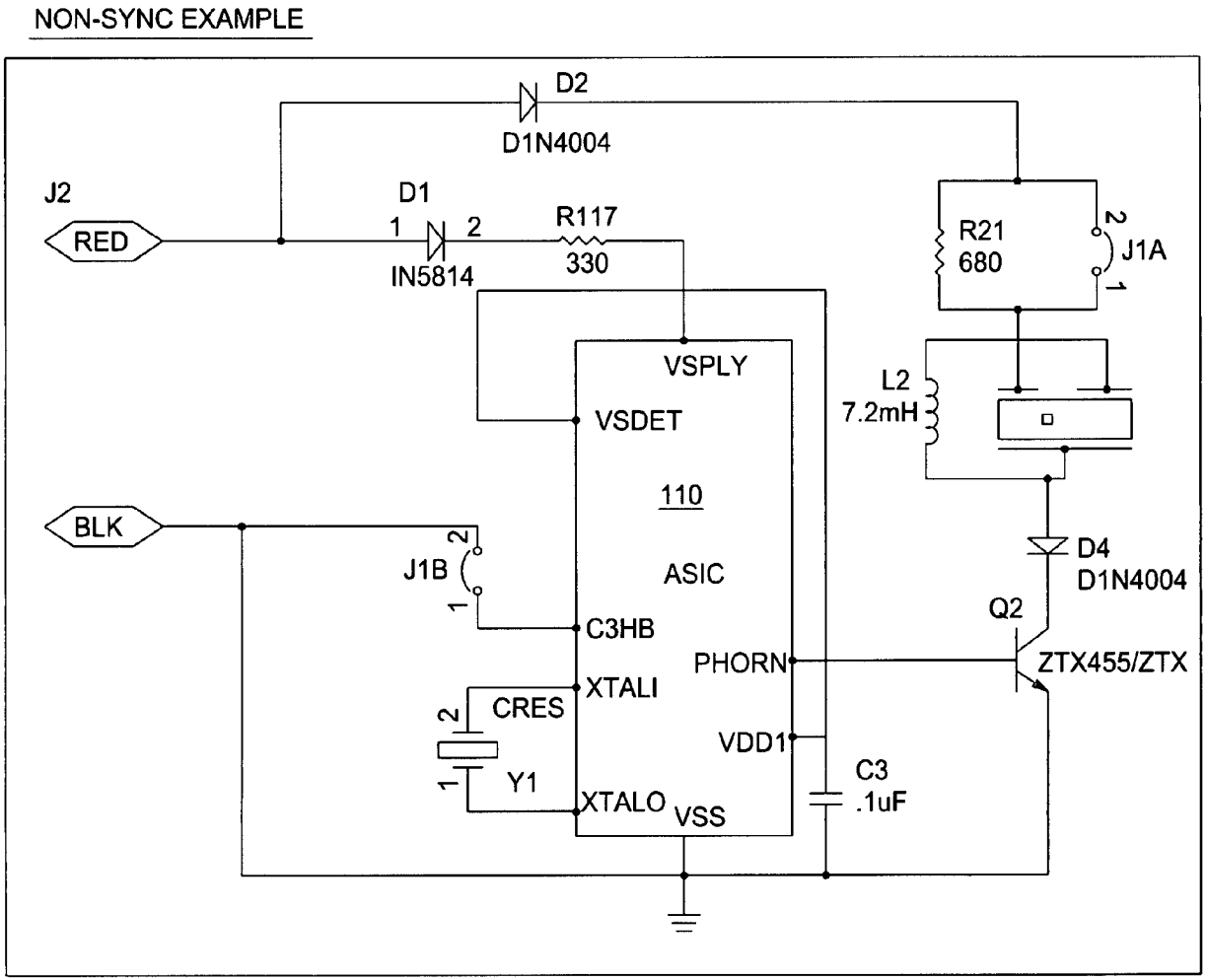
FIG. 9 illustrates a circuit diagram of one embodiment of an alarm unit employed in the present invention.

FIG. 9 illustrates a circuit diagram of one embodiment of an alarm unit 900 employed in the present invention. FIG. 9 illustrates an ASIC 110 implemented in an eight-pin package. Various features of the alarm unit 900 are disclosed below.

In one embodiment, the non-sync implementation removes the Vsdet resistor divider. It should be noted that the ASIC 110 will not operate with full-wave rectified supply unless Vdd1 is decoupled: 24 v (16-33 v) operation requires at least 2 μF, 12 v (8-17 v) operation requires at least 3 μF of decoupling.

Although various embodiments which incorporate the teachings of the present invention have been shown and described in detail herein, those skilled in the art can readily devise many other varied embodiments that still incorporate these teachings.

What is claimed is:

1. An alarm unit, comprising:

a flash circuit having a strobe for generating a flash;

an audio circuit having at least one of: a horn or a buzzer for generating an audio warning signal;

an application specific integrated circuit (ASIC) coupled to said flash circuit, and to said audio circuit, for triggering said audio warning signal, wherein said ASIC selects an audio frequency for said audio warning signal, wherein said audio frequency being a sweep frequency of approximately 2500 Hertz (Hz) to 4000 Hz, and a sync pulse detection circuit coupled to said ASIC for detecting a sync pulse, wherein the sync pulse is detected if a voltage drops to a logic low on a pin of the ASIC for greater than a predetermined time period, wherein the detecting of the sync pulse causes the strobe to generate the flash and causes the horn or the buzzer to generate the audio warning signal in a code 3 pattern, wherein the code 3 pattern comprises an approximately 0.5 second period of silence and an approximately 0.5 second period of sound repeated three times followed by an approximately 1.0 second period of silence.

2. An alarm unit, comprising:

a flash circuit having a flashtube for generating a flash;

an application specific integrated circuit (ASIC) coupled to said flash circuit, for triggering said flash;

an audio circuit having at least one of: a horn or a buzzer, coupled to said ASIC, where said audio circuit generates an audio warning signal, wherein said ASIC selects an audio frequency for said audio warning signal, wherein said audio frequency being a sweep frequency of approximately 2500 Hertz (Hz) to 4000 Hz; and a sync pulse detection circuit coupled to said ASIC for detecting a sync pulse, wherein the sync pulse is detected if a voltage drops to a logic low on a pin of the ASIC for greater than a predetermined time period, wherein the detecting of the sync pulse causes the flashtube to generate the flash and causes the horn or the buzzer to generate the audio warning signal in a code 3 pattern, wherein the code 3 pattern comprises an approximately 0.5 second period of silence and an approximately 0.5 second period of sound repeated three times followed by an approximately 1.0 second period of silence.

3. The alarm unit of claim 2, wherein said flash circuit further comprises a voltage doubler.

4. The alarm unit of claim 2, wherein said ASIC provides a charge cycle that is greater than 8 kilohertz.

* * * * *